United States Patent [19]

Frank

[11] Patent Number: 4,923,785

[45] Date of Patent: May 8, 1990

[54] BLEACHING BATH CONCENTRATE

[75] Inventor: Karl Frank, Leverkusen, Fed. Rep. of Germany

[73] Assignee: AGFA Gevaert AG, Leverkusen, Fed. Rep. of Germany

[21] Appl. No.: 215,304

[22] Filed: Jul. 5, 1988

[30] Foreign Application Priority Data

Jul. 15, 1987 [DE] Fed. Rep. of Germany ..... 3723307

[51] Int. Cl.[5] ..... G03C 5/44

[52] U.S. Cl. ..... 430/430; 430/460; 430/461; 430/462; 430/393; 252/94; 252/102

[58] Field of Search ..... 430/430, 460, 461, 393, 430/462; 252/94, 102

[56] References Cited

U.S. PATENT DOCUMENTS

| | | | |
|---|---|---|---|
| 4,301,236 | 1/1980 | Idota et al. | 430/430 |
| 4,745,048 | 5/1988 | Kishimoto et al. | 430/430 |
| 4,769,313 | 9/1988 | Fujimoto et al. | 430/381 |

*Primary Examiner*—Paul R. Michl
*Assistant Examiner*—Thon Chea

[57] ABSTRACT

The one-part aqueous bleaching bath concentrate containing an ammonium iron (III) complex salt concentration of at least 0.4 mol per liter; an ammonium bromide concentration of from 1.5 to 3 mol per liter, an ammonium nitrate concentration of from 0.25 to 1 mol per liter and a pH below 3 is stable in storage.

5 Claims, No Drawings

BLEACHING BATH CONCENTRATE

This invention relates to a bleaching bath concentrate for the preparation cf photographic bleaching baths, in particular a one-part bleaching bath concentrate which is stable under tropical storage conditions.

In silver halide colour photography, the metallic silver formed in the development process is converted by oxidizing agents in the presence of halide ions into a silver halide which can be fixed. The oxidizing agent used is generally the ammonium salt of an iron (III) complex with an amino polycarboxylic acid, for example the ammonium-iron (III)EDTA complex salt.

A bleaching bath ready for use for colour negative film processing may contain, for example, the following components per liter of aqueous solution:

100 g of $NH_4Fe(III)$-EDTA
100 to 150 8 of $NH_4Ba$
10 to 20 g of $NH_4$ acetate, and it has a pH of 6. Such a bath may in addition contain nitrate ions.

In the course of use, the iron-III in the bath is reduced to iron-II, the alkaline developer carried into the bath not only dilutes the bath but also raises the pH and the halide ions, especially bromide ions, are used up. The iron-II is reoxidized to iron-III by a continuous supply of air and the dilution, increase in pH and loss of bromide ions are compensated by the addition of a more highly concentrated and more highly acid bleaching bath replenisher.

A replenisher of this kind also serves as basis for the first bleaching bath, which is prepared by simply diluting the replenisher with water and adding a starter.

If the replenisher is at a sufficiently high concentration and has a sufficiently high acid content, it may be added in such small volumes that virtually no overflow is produced (level replenishment). In most cases, however, the bath is replenished with 1 litre per $m^2$ of a solution which has a concentration about 20% higher than that of the tank contents, so that an overflow is produced which must be trapped and collected. This overflow, which has the same composition as the contents of the tank, is then converted into replenisher by the addition of concentrates or solids and acid and is circulated.

This substance added to the circulation is known as the regenerator.

Bleaching baths, replenishers, and regenerators of the type described above: are marketed in various forms; as single part or multi-part compositions in a solid or liquid form, the liquid preparations being more popular as being more convenient to use. The concentrates are of such a composition that a bath ready for use may be prepared from them by dilution or by mixing and dilution.

A one-part bleaching bath concentrate is, of course, preferable but it has been found that known one-part bleaching bath concentrates give rise to stability problems, especially when stored under tropical conditions. It is therefore also customary to use two-part concentrates in which one part is at a low pH and contains the total quantity of oxidizing agent and a small quantity of halide ions while the other part contains most of the halide ions and has been adjusted to a higher pH with ammonia and acetic acid.

It was an object of the present invention to provide a onepart, stable bleaching bath concentrate which could be used directly as level replenisher or as regenerator and which could also be used for the initial bleaching bath and for preparing a replenisher.

This object is achieved with an aqueous bleaching bath concentrate at a pH below 3, an ammonium iron (III) complex salt concentration of at least 0.4 mol/l, an ammonium bromide concentration of from 1.5 to 3 mol/l, an ammonium nitrate concentration of from 0.25 to 1 mol/l and optionally an acetic acid concentration of up to 1 mol/l.

The bleaching bath concentrate according to the invention preferably has a pH of from 2.3 to 2.8, an ammonium iron (III) complex salt concentration of from 0.4 to 0.9 mol/l, an ammonium nitrate concentration of from 0.3 to 0.8 mol/l and an acetic acid concentration of from 0.3 to 0.8 mol/l.

The complex formers used for the iron (III) ions may be, for example, ethylene diaminotetra-acetic acid (EDTA), 1,3-propylene-diaminotetra-acetic acid (PDTA), 1,2-propylene-diaminotetra-acetic acid, 1,4-butylene-diaminotetra-acetic acid, diethylene triaminopenta-acetic acid, 1,4-cyclohexylene-diaminotetra-acetic acid, methyliminio-diacetic acid and any mixture of these complex formers. Ethylene diaminotetra-acetic acid, diethylene triaminopenta-acetic acid and mixtures of ethylene diaminotetra-acetic acid and 1,3-propylene diaminotetra-acetic acid in molar ratios of from 5:1 to 1:2 are preferred. The complex former is preferably used in slight excess over the iron ions, e.g. an excess of up to 0.03 mol per mol of iron ions.

A bleaching bath for the first filling of the tank is normally prepared from the bleaching bath concentrate by diluting the concentrate and adding a starter. Alkaline compounds such as ammonia or potassium carbonate may be used as starters but it is particularly advantageous to use non-volatile, water soluble amines, for example an alkanolamine. Ethanolamine is particularly preferred.

The invention further relates to the use of the bleaching bath concentrate according to the invention for the preparation of a bleaching solution ready for use by diluting the concentrate with water and adding a starter, characterised in that the starter used is a non-volatile, water soluble amine added in the quantity required to adjust the pH. to 5–8.

The bleaching bath concentrate according to the invention is suitable for the preparation of bleaching solutions ready for use for the preparation of bleaching bath replenishers, as level replenisher and as regenerator for a wide variety of colour photographic materials such as colour negative films, colour reversal films, colour negative paper and colour reversal paper.

COMPARISON EXAMPLE (recommended for process C-41 B/C-41 BN)

A bleaching bath was prepared from the following separate solution:

| Part A |
|---|
| aqueous solution of 304 g/l $NH_4Br$ (3.10 mol/l) |
| 68 g/l $CH_3COOH$ (1.14 mol/l) |
| 12.8 g/l $NH_3$ (0.75 mol/l) |
| pH: 4.8 |
| Part B: |
| aqueous solution of 199 g/l $NH_4Fe(III)$-EDTA (0.55 mol/l) |
| 113 g/l $NH_4Fe(III)$-PDTA (0.30 mol/l) |
| 27 g/l $NH_4Br$ (0.28 mol/l) |

-continued

| Part A |
|---|
| 70.4 g/l $NH_4NO_3$ (0.88 mol/l) |
| pH: 2.4 |
| Part C (starter): |
| aqueous solution of 144.5 g/l $NH_3$ (9.4 mol/l). |

305 ml of Part A, 305 ml of Part B, 12 ml of Part C and 378 ml or water were mixed together and used as bleaching bath. This bath has a pH of 5. Bleaching of a colour negative film has completed in 3 minutes with type correct sensitometric results. Part A and Part B each remained unchanged for at least two years under tropical conditions.

EXAMPLE 1

A bleaching bath was prepared from the following one-part bleaching bath concentrate:

| | |
|---|---|
| Concentrate: | |
| Water dist. | 300 ml |
| $NH_4$—Fe(III)-EDTA solution | 333 ml, 202 g solids content |
| Ammonium bromide | 307 g |
| glacial acetic acid | 38 ml |
| $HNO_3$ conc. 65% by weight | 43 ml, yields 48 g of $NH_4NO_3$ |
| Water dist. up to | 1000 ml |
| pH = 2.6 | |
| Starter: | |
| Ethanolamine, 98 to 100% | |

490 ml of concentrate and 27 ml of starter were mixed with water made up to 1000 ml. The pH of the mixture was 6.0. Bleaching of a colour negative film was completed in 4 minutes with type correct sensitometric results. The concentrate remained unchanged for at least two years under tropical conditions.

The following formulation was used for the preparation of a replenisher:

560 ml of concentrate, 26.5 ml of starter and water up to 1000 ml. The pH of the preparation was 5.7.

When the concentrate was used as regenerator, 60 ml of concentrate were added to 1 litre of overflow. The resulting pH was 5.7.

EXAMPLE 2

Similar to Example 1 but with the following alteration: 202 g of $NH_4$-Fe(III)-EDTA are replaced by a mixture of 130 g of $NH_4$-Fe(III)-EDTA and 75 g of NH4-Fe(III)-PDTA. The bleaching time of a colour negative film was reduced to 3 minutes, with the results otherwise unchanged.

I claim:

1. Aqueous, one-part bleaching bath concentrate for producing a bleaching bath for the processing of color photographic materials comprising an ammonium iron (III)-complex salt concentration of at least 0.4 mol/l, an ammonium bromide concentration of from 1.5 to 3 mol/l, an ammonium nitrate concentration of from 0.25 to 1 mol/l and optionally an acetic acid concentration of up to 1 mol/l and a pH of $<3$.

2. Aqueous, one-part bleaching bath concentrate according to claim 1, having an ammonium iron (III)-complex salt concentration of from 0.4 to 0.9 mol/l, an ammonium nitrate concentration of from 0.3 to 0.8 mol/l, an acetic acid concentration of from 0.3 to 0.8 mol/l and a pH of from 2.3 to 2.8.

3. Aqueous, one-part bleaching bath concentrate according to claim 1, characterised in that ethylene diaminotetraacetic acid, diethylene triaminopentaacetic acid or mixtures of ethylene diaminotetra-acetic acid and 1,3-propylene diaminotetra-acetic acid are used as complex formers.

4. In the process of preparing a photographic bleaching bath with a bleaching bath concentrate according to claim 1 which comprises the step of diluting the concentrate of claim 1 with water and adding as a starter a non-volatile water-soluble amine to adjust a pH of 5 to 8.

5. In the process of claim 4 adding ethanolamine as the starter.

* * * * *